United States Patent [19]

Utsch et al.

[11] 4,366,825

[45] Jan. 4, 1983

[54] EXPANSION OF TOBACCO

[75] Inventors: Francis V. Utsch, Midlothian; Henry B. Merritt; Larry M. Sykes, both of Richmond, all of Va.

[73] Assignee: Philip Morris Incorporated, New York, N.Y.

[21] Appl. No.: 96,409

[22] Filed: Nov. 21, 1979

[51] Int. Cl.[3] ..... A24B 3/18

[52] U.S. Cl. ..... 131/296; 131/900

[58] Field of Search ..... 131/140 P, 900, 291, 131/292, 294, 295, 296

[56] References Cited

U.S. PATENT DOCUMENTS

| | | | |
|---|---|---|---|
| 4,044,780 | 8/1977 | Kelly | 131/140 P |
| 4,308,876 | 1/1982 | Rothchild | 131/293 |
| 4,336,814 | 6/1982 | Sykes et al. | 131/291 |

FOREIGN PATENT DOCUMENTS

| | | | |
|---|---|---|---|
| 1484536 | 9/1977 | United Kingdom | 131/140 P |

*Primary Examiner*—V. Millin

*Attorney, Agent, or Firm*—Arthur I. Palmer; George E. Inskeep

[57] ABSTRACT

Impregnated tobacco is expanded in an expansion operation involving the entrainment of the impregnated tobacco in a heated gas stream under high temperature-short entrainment time conditions resulting in a product of improved quality and enhanced expansion.

2 Claims, 4 Drawing Figures

8" TOWER WITH TANGENTIAL SEPARATOR
IMPREGNATION PRESSURE = 400 PSIG
TOWER VELOCITY = 125 ft./sec.
FEED RATE = 3 1/8 lb/min.

8" TOWER COMPARISON OF CYCLONE & TANGENTIAL SEPARATORS
IMPREGNATION PRESSURE 400 PSIG
TOWER VELOCITY = 125 ft/sec.
FEED RATE = 31/8 lb/min.
VARIOUS TEMPERATURES

EXPANSION OF TOBACCO

BACKGROUND OF THE INVENTION

The expansion of tobacco to give it improved filling power per unit weight, i.e. greater volume/g, can be effected in a number of known manners. Most generally, however, it is accomplished by impregnating the tobacco, for example in the form of cut filler, with an impregnating agent or agents and then subjecting the impregnated material to rapid heating, to drive off or volatilize the impregnant thereby causing expansion of the tobacco. Heating conveniently can be effected in a stream of hot gas flowing through a pneumatic conveying column, commonly referred to as a "tower". Following heating in the tower, the tobacco is separated from the gas stream, the separation of the product heretofore being accomplished with a cyclone separator.

U.S. Pat. No. 3,771,533 discloses the impregnation of tobacco filler with ammonia and carbon dioxide as expansion agents. The impregnated tobacco material is subjected to rapid heating, for example with a stream of hot air or air mixed with superheated steam, whereby the tobacco is puffed as the impregnant is converted to a gas.

Belgian Pat. No. 821,568 and pending U.S. application Ser. No. 822,793 disclose methods for impregnating tobacco with liquid carbon dioxide, converting a portion of the impregnant to solid form and then rapidly heating the impregnated tobacco to volatilize the carbon dioxide and puff the tobacco.

Pending U.S. application Ser. Nos. 891,290 and 891,468 each disclose impregnation of the tobacco with gaseous carbon dioxide under pressure and then subjecting the tobacco to rapid heating after pressure reduction. All aforementioned methods disclose effecting expansion of the tobacco in a tower with a flow of heated gas, with separation of the expanded tobacco from the gas stream being achieved in a cyclonic separator.

BRIEF SUMMARY OF THE PRESENT INVENTION

It has been found that the expansion of impregnated tobacco can be effected with salutary results with regard to both the degree of expansion and quality of the product by entraining the impregnated tobacco in a highly heated gas stream for a very short time period, e.g., a gas stream at a temperature of at least 525° F. or more for a time of up to about 3 seconds. This represents a significant departure from prior tower operations employing lower gas stream temperature and considerably longer residence time of the tobacco in the gas stream. Essential in achieving these aims is the employment of a tangential separator (sometimes referred to by those skilled in the art as a skimmer or a skimming chamber) for separating the expanded tobacco from the gas stream at the upper or take-off end of the tower.

Particle residence time in the tower is typically 0.2 to 2 seconds, plus only about 1 second in the tangential-type separator. In a cyclone-type separator the tobacco residence time therein is much higher, being about 4 to 12 seconds. The heated gas entering a cyclone separator from the tower is hot enough to dry the product excessively but has too slow a relative flow with regard to the particles to provide a rate of heat transfer effective for optimized expansion. The added residence time in the cyclone thus excessively dries the tobacco making it brittle and subject to more abrasion and breakage. The reduction in retention/drying time possible in accordance with the present invention involving, inter alia, use of a tangential separator permits the expansion tower heated gas stream temperature to be about 100° to 200° F. (55° to 110° C.) higher than where cyclonic separation is employed with the result that a substantially greater degree of expansion is realized. This is believed to be caused by the greater rate of initial heat transfer to the impregnated tobacco at the time when most of the expansion is thought to occur. The result is a high degree of expansion without toasting the product. Furthermore, cyclone separators have a much longer retention time with increasing size; this scale-up difficulty is not encountered to the same extent with a tangential separator.

BRIEF DESCRIPTION OF THE DRAWINGS

A fuller understanding of the nature and objects of the invention will be had from the following detailed description taken in conjunction with the accompanying drawings in which.

Throughout the following description, like reference numerals are used to denote like parts in the drawings.

DESCRIPTION OF THE PREFERRED EMBODIMENTS

The present invention is concerned with the expansion of tobacco and with the manner in which the impregnated tobacco is heated to drive the impregnant therefrom and thus expand same, and particularly the manner in which the thus expanded tobacco is separated from the heated gas stream. As indicated earlier, the separation of the expanded tobacco from the gas stream as it leaves the tower unit is effected by means of a tangential separator operation in which the tobacco-containing gas stream is passed into a tangential separator unit as contrasted with prior art utilization of a cyclonic-type separator for this separation step.

Figure 1:
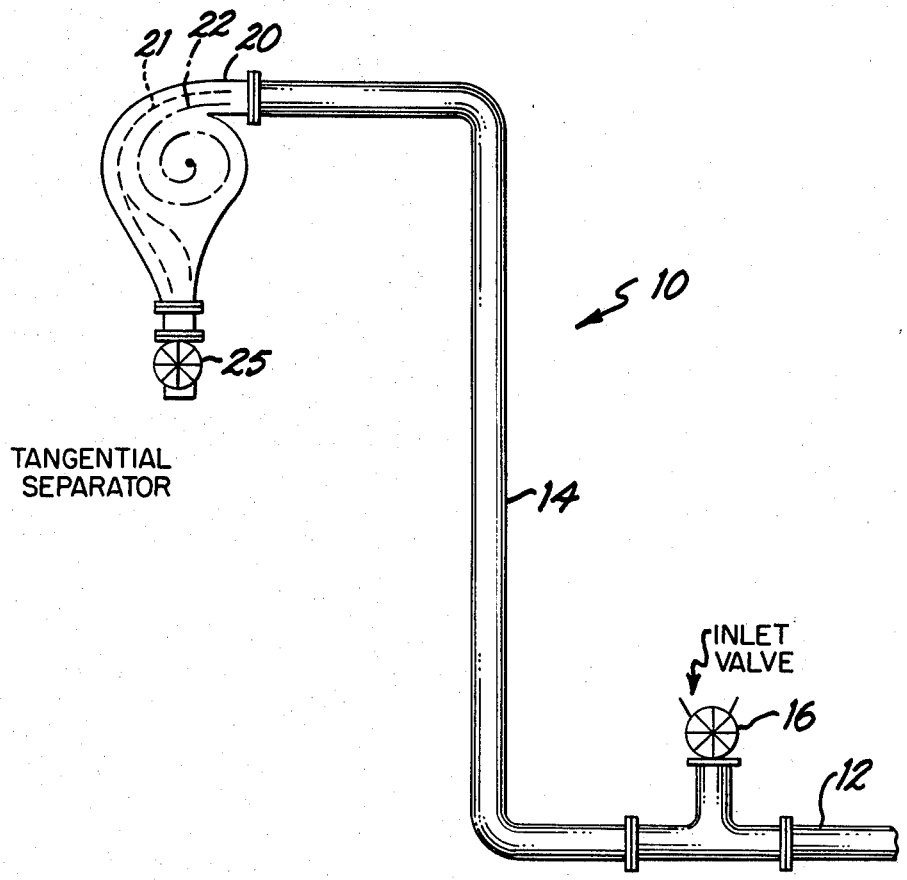
FIG. 1 is a schematic depiction of a tower unit employed in heating impregnated tobacco to expand same in accordance with the present invention.

With reference now to FIG. 1 of the drawings, apparatus is depicted for heating impregnated tobacco to expand same. A heated gas stream, e.g. heated air or a mixture of heated air and steam at a temperature of at least 525° F., is passed through an inlet pipe section 12 to a tower unit 10 which has an elongated pipe member 14. The impregnated tobacco is introduced through inlet valve 16, and heated as it passes through the system so as to drive the impregnant therefrom and cause expansion of the tobacco. The residence time of the tobacco in the tower is approximately 0.2 to 2.0 seconds, after which the tobacco-containing gas stream enters a tangential separator unit 20 wherein the tobacco is separated from the heated gas stream, the tobacco remaining resident in unit 20 for about 1 second.

An important advantage of the present invention is that due to the shorter residence time of the tobacco material in the separator unit 20, the stream temperature can be substantially higher than heretofore possible. For example, the temperature of the heated gas stream can be from 100° to 200° F. higher than that which has been used in the past in connection with a cyclonic separation operation wherein the tobacco can have a residence time in the separator from about 4–12 seconds. Preferably in connection with the expansion of shredded tobacco filler wherein the same has been impregnated with carbon dioxide alone, or a mixture of carbon dioxide and ammonia, for example, the temperature of the heated gas stream will ordinarily be in the range of about 525° to about 650° F.

Within the tangential separator 20, the tobacco follows the course 21 shown is dashed lines of uniform length, whereas the gas stream follows a path 22 indicated by alternating long and short dashed lines. The tobacco leaves the separator through outlet valve 25. The separated gas stream, on the other hand, follows the convoluted course depicted, as those skilled in the art will recognize, such tangential separators being provided with convoluted vanes for directing the gas stream flow course, with ultimate exit of the gas from the separator being axially of the unit, i.e., in the direction of the viewer in FIG. 1.

In the apparatus depicted, it will be apparent that pipe member 14 defines a vertically extending passageway, with 90° elbows at the inlet and outlet ends thereof. The use of such elbows is desirable to control retention time in the tower and to increase the particle/gas slip velocity to improve heat transfer to the particles. It will be appreciated, however, that the main straight portion of the tower passageway need not be vertically disposed, and that elbows of various angles may be used to similar effect; also, that the inlet and outlet lines leading to and from the tower passageway may be disposed in the same plane or at right angles to each other or either may be at any convenient angle to the passageway.

The tower tangential separator operation in comparison with a cyclone separator operation shows the tangential system to yield expanded tobacco of significantly higher cylinder volume, and hence greater filling power, for equal tower exit moistures (78 vs. 63 cc/10 g).

Figure 2:
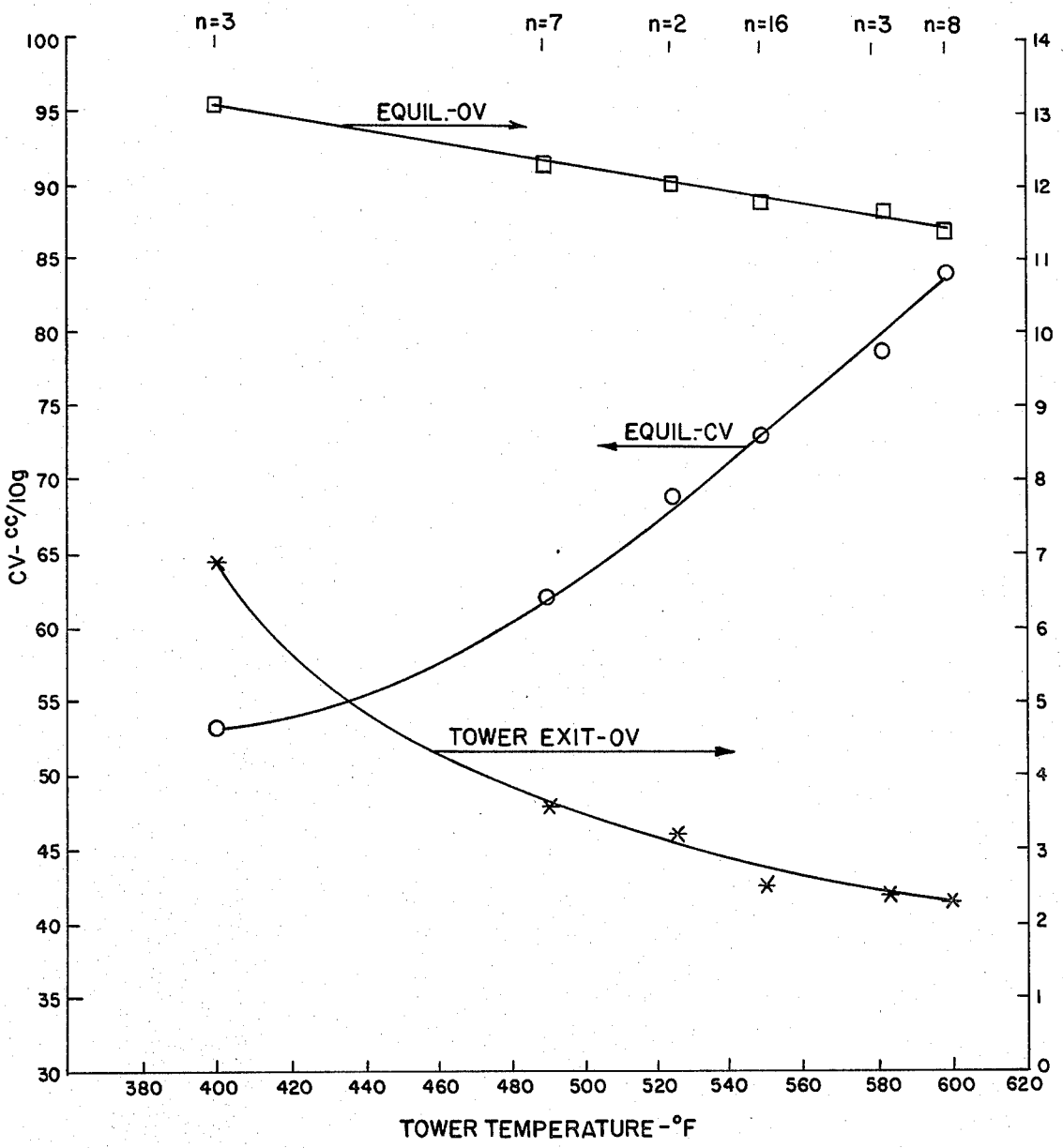
FIGS. 2–4 depict graphically and comparatively the enhanced tobacco expansion results achieved by the present invention wherein higher gas stream temperature and a tangential separation operation is employed in contrast to the heretofore used lower gas stream temperature and cyclonic separation operation.
Figure 3:
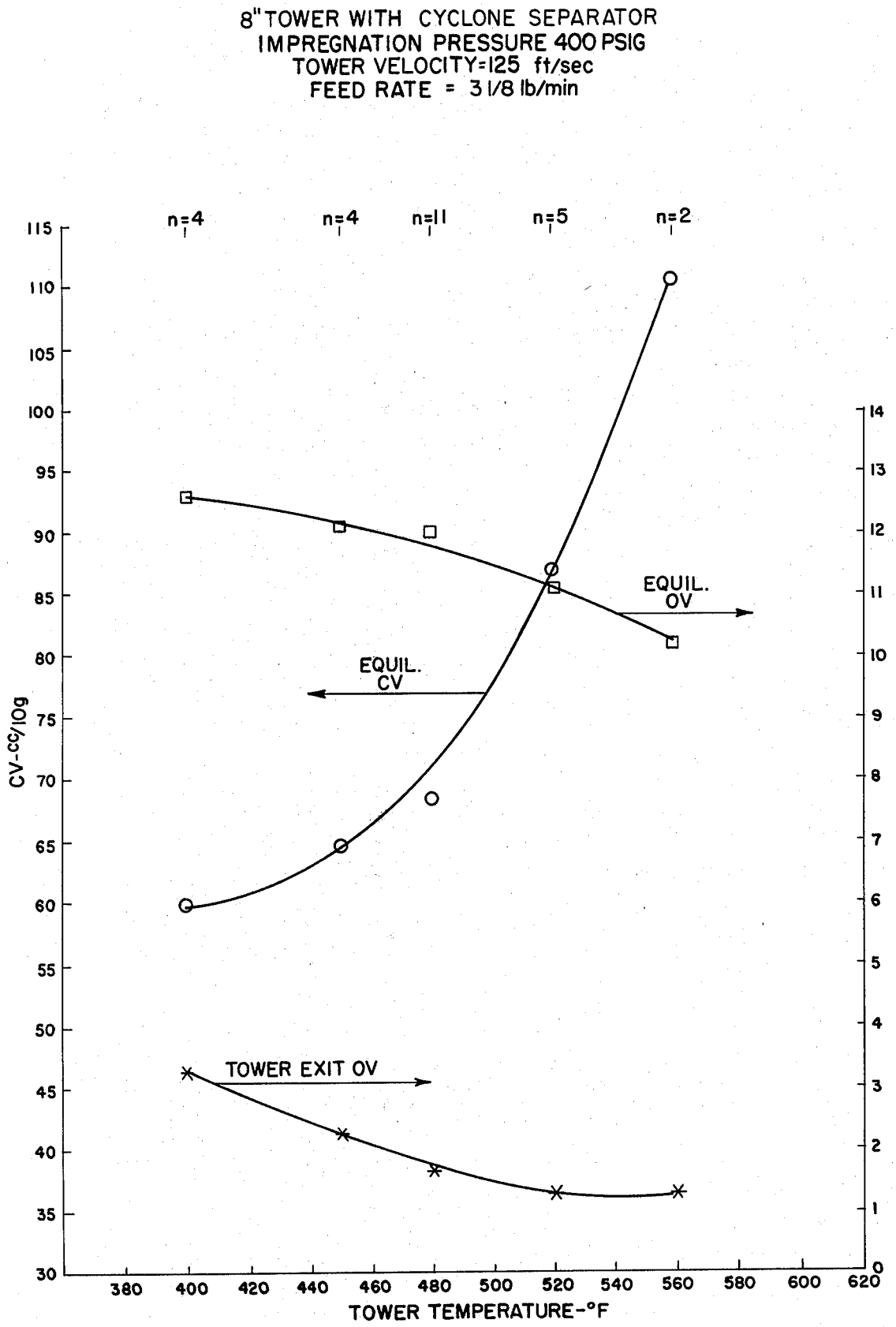

FIGS. 2 and 3 depict the equilibrated OV (oven volatiles), CV (cylinder volume) and tower exit OV vs. tower gas temperature for the tangential and cyclone operation respectively. In practice, the tangential operation can be run with a gas stream temperature as hot as 600° F., or much higher, without excessively drying the tobacco, compared to a maximum gas temperature of only about 500° to 520° F. for an effective cyclone operation.

It will be noted that the exit moistures vs. tower temperature are higher for the tangential operation. This is due at least in part to the differences in the particle path or residence time in the two systems. In the tangential unit, a tobacco particle enters the separator at the top, skims the wall from top to bottom for a 90°+ turn and then exits via the rotary air lock. The net difference is that tobacco particles spend a much longer time in a cyclone unit than in a tangential unit; and in achieving drying in a tangential unit with shorter residence time it is possible to significantly increase the gas stream temperature.

Figure 4:
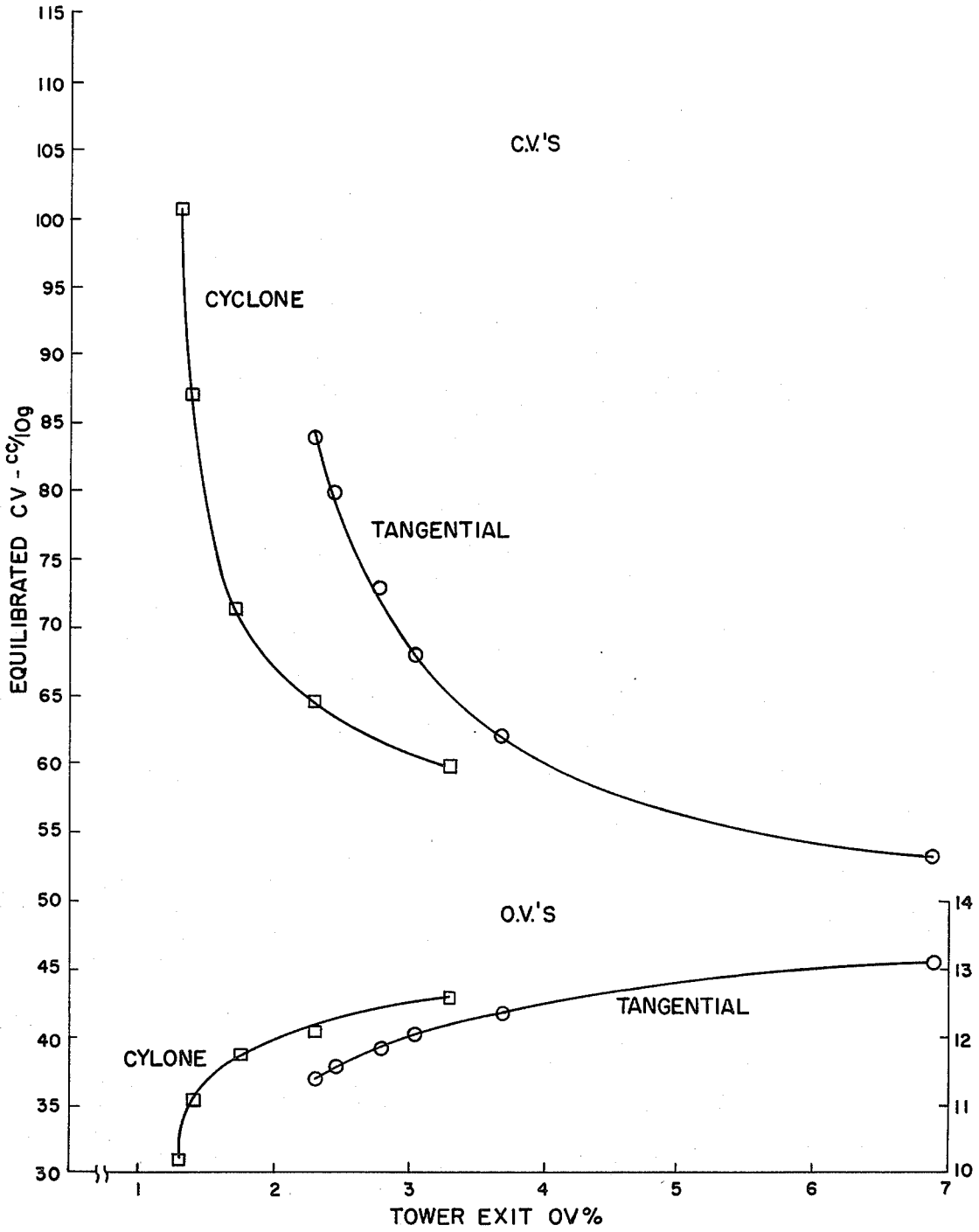

Comparing FIGS. 2 and 3 at an exit OV of 2.3%, the cyclone system gas temperature is 450° F. vs. 600° F. for the tangential system. The equilibrated CVs, however, are 65 cc/10 g for the cyclone vs. 84 cc/10 g for the tangential. By running hotter in the tower (higher stream temperature), expansion with $CO_2$ impregnated filler is enhanced. This is shown in FIG. 4 where equilibrated CVs and OVs are shown for both types of separators vs. tower exit OV.

This invention may be illustrated by the following examples.

EXAMPLE 1

Two batches of 10 pounds each of bright cut filler were processed in each system using two impregnation methods to compare the systems for carbon dioxide expansion. The same source and oven volatiles (OV) level of starting material insured comparability. Both expansion systems employed a 4-inch diameter tower 24 feet in length and having 140 feet/second flow of superheated steam containing about 15% air; conditions were controlled to provide an exit OV of the product of approximately 2.4%. One system employed a cyclone separator and a steam inlet temperature of 218° C., the other used a tengential separator and steam at 316° C. Liquid impregnation and gas impregnation methods were compared at 800 psig. The products were reordered to standard conditions (72° F. 60% RH) and compared for filling power and sieve test values. The results in Table 1 show the superiority of the tangential separator.

TABLE 1

BRIGHT FILLER EXPANSION WITH CARBON DIOXIDE

| Impregnation Method* | Take-Off** | Percent Exit OV | Reordered CV, cc/10g | Reordered Percent OV | Percent Sieve Longs | Percent Sieve Small + Fines |
|---|---|---|---|---|---|---|
| L | T | 2.4 | 86.5 | 11.5 | 39.6 | 1.54 |
| L | C | 2.4 | 79.3 | 11.0 | 35.7 | 2.77 |
| G | T | 2.8 | 86.8 | 11.3 | 44.1 | 1.44 |
| G | C | 2.4 | 82.1 | 11.0 | 36.1 | 2.67 |

*L signifies liquid carbon dioxide as disclosed in Belgian Patent 821,568; G signifies gaseous carbon dioxide as disclosed in U.S. application Ser. No. 891,468
**T is tangential separator; C is cyclone.

EXAMPLE 2

Batches of approximately 100 pounds each of bright tobacco filler were impregnated with ammonia/carbon dioxide by methods disclosed in U.S. Pat. No. 3,771,533, expanded at 200 pounds/hour in an 8-inch diameter tower with 85% superheated steam flowing at about 125 feet/second and recovered in a tangential separator. The results tabulated in Table 2 indicate good cylinder volume on reordering, considering the relatively high exit OV of the product and equilibrium OV.

TABLE 2

BRIGHT FILLER EXPANSION WITH $NH_3/CO_2$

| Carrier Gas Temperature °C. | Percent Exit OV | Reordered CV, cc/10g | Reordered Percent OV |
|---|---|---|---|
| 274 | 6.0 | 78.6 | 11.9 |

TABLE 2-continued

| BRIGHT FILLER EXPANSION WITH $NH_3/CO_2$ | | | |
|---|---|---|---|
| Carrier Gas | Percent | Reordered | |
| Temperature °C. | Exit OV | CV, cc/10g | Percent OV |
| 288 | 5.1 | 80.0 | 11.7 |

What is claimed is:

1. In a method for heating a carbon dioxide expansion agent impregnated tobacco to expand same, the steps of:

entraining the impregnated tobacco in a stream of steam-containing air flowing in a generally upwardly vertically directed flow course and heated to a temperature in a range of at least about 525° F. to about 650° F. for a period of between 0.2 and 2 seconds to rapidly volatilize the expansion agent from the tobacco and thereby expand the tobacco; and then delivering the stream and entrained expanded tobacco along a horizontal flow course for entry to a tangential separation operation to separate therein the tobacco from the stream.

2. The method of claim 1 in which the gas stream is heated to a temperature of about 600° F.

* * * * *